US010859344B1

(12) United States Patent
Marfione

(10) Patent No.: US 10,859,344 B1
(45) Date of Patent: Dec. 8, 2020

(54) ALIGNMENT AID FOR A SUPPRESSOR

(71) Applicant: Anthony Louis Marfione, Fletcher, NC (US)

(72) Inventor: Anthony Louis Marfione, Fletcher, NC (US)

(73) Assignee: Microtech Knives, Inc., Bradford, PA (US)

( * ) Notice: Subject to any disclaimer, the term of this patent is extended or adjusted under 35 U.S.C. 154(b) by 0 days.

(21) Appl. No.: 16/661,020

(22) Filed: Oct. 23, 2019

(51) Int. Cl.
*F41G 1/02* (2006.01)
*F41A 21/30* (2006.01)

(52) U.S. Cl.
CPC ..... *F41G 1/02* (2013.01); *F41A 21/30* (2013.01)

(58) Field of Classification Search
CPC ... F41G 1/00; F41G 1/02; F41G 1/027; F41G 1/033; F41G 1/04; F41G 1/06; F41G 1/065; F41G 1/10; F41G 1/16; F41G 1/22; F41G 1/26; F41G 1/387; F41G 1/393; F41G 1/42; F41G 1/425; F41G 1/545; F41G 11/001; F41G 11/002; F41G 11/004; F41A 21/24; F41A 21/30; F41A 21/32; F41A 21/325; F41A 21/34; F41A 21/36; F41A 21/38
USPC ..... 42/111, 112, 133, 143; 89/14.2–14.4, 89/41.17, 41.19; 181/223
See application file for complete search history.

(56) References Cited

U.S. PATENT DOCUMENTS

| | | | | |
|---|---|---|---|---|
| 2,236,736 | A * | 4/1941 | Scott | F41G 1/35 362/110 |
| 4,228,605 | A * | 10/1980 | Chacornac | F41A 21/08 42/106 |
| 8,919,027 | B2 | 12/2014 | Curry | |
| 9,410,755 | B2 | 8/2016 | Langevin | |
| 10,352,642 | B1 * | 7/2019 | Lee | F41A 21/30 |
| 10,352,658 | B1 * | 7/2019 | Aslin | F41G 11/001 |
| 2017/0131065 | A1 * | 5/2017 | Whitson | F41G 1/01 |

OTHER PUBLICATIONS

Nick Leghorn, Silencer Review: Alpha Dog Silencer, Jan. 9, 2017, The Truth About Guns, pp. 1-5 (Year: 2017).*

* cited by examiner

*Primary Examiner* — Stephen Johnson
*Assistant Examiner* — Benjamin S Gomberg
(74) *Attorney, Agent, or Firm* — Steve LeBlanc, LLC

(57) ABSTRACT

An alignment aid for a suppressor includes a sleeve having an external surface and an internal surface. An alignment slot extends longitudinally along the external surface of the sleeve. A groove is in the internal surface, and a strip is at least partially in the groove. A set screw is engaged with the strip to bias the strip radially inward from the groove.

20 Claims, 3 Drawing Sheets

ALIGNMENT AID FOR A SUPPRESSOR

FIELD OF THE INVENTION

The present disclosure generally involves an alignment aid for a suppressor. In particular embodiments, the alignment aid may be installed on the suppressor to supplement or replace existing sights on a firearm when the suppressor is used with the firearm.

BACKGROUND OF THE INVENTION

Many firearms include an alignment aid that assists a user to quickly and accurately aim the firearm. For example, handguns, shotguns, and rifles may include traditional "iron" sights that allow the user to aim the firearm at a target. Traditional iron sights may include a rear sight near the rear of the firearm and/or a front sight near the muzzle end of the firearm. The user may visually align the front and/or rear sights along the line of sight to the target to accurately aim the firearm at the intended target. The traditional iron sights are relatively inexpensive, easy to use, and often adjustable to provide a very cost-effective alignment aid for firearms.

A suppressor (also commonly referred to as a silencer) is a device that attaches to the muzzle of the firearm to dissipate energy of the combustion gases to reduce the noise signature of the firearm. The suppressor generally includes a number of baffles serially arranged or stacked inside a casing. A longitudinal pathway through the baffle stack allows the projectile to pass through the suppressor unobstructed, while the baffle stack redirects the combustion gases inside the casing to allow the combustion gases to expand, cool, and otherwise dissipate energy before exiting the suppressor. The combustion gases thus exit the suppressor with less energy, reducing the noise signature associated with the discharge of the firearm.

While effective at reducing the noise signature of the firearm, the size of the suppressor often causes the suppressor to extend above the muzzle of the firearm to block the line of sight between the traditional iron sights and the target. As a result, various devices have been created to supplement or replace the traditional iron sights to accommodate the use of a suppressor. For example, the traditional iron sights may be replaced by taller iron sights that create a line of sight above the suppressor to the target. However, the taller iron sights create additional interference with a holster when the suppressor is not used, and changing between traditional iron sights and taller iron sights is time consuming and requires separate calibration of each sight to ensure an accurate alignment aid. Therefore, the need exists for an improved alignment aid for use with the suppressor to supplement or replace the traditional iron sights when the suppressor is installed on the firearm.

BRIEF DESCRIPTION OF THE INVENTION

Aspects and advantages of this disclosure are set forth below in the following description, or may be obvious from the description, or may be learned through practice of the invention.

One embodiment of the present invention is an alignment aid for a suppressor. The alignment aid includes a sleeve having an external surface and an internal surface. An alignment slot extends longitudinally along the external surface of the sleeve. A groove is in the internal surface, and a strip is at least partially in the groove. A set screw is engaged with the strip to bias the strip radially inward from the groove.

Another embodiment of the present invention is an alignment aid for a suppressor that includes a sleeve and an alignment slot that extends longitudinally along the sleeve. An internal surface defined by the sleeve has a cylindrical shape. A groove is in the internal surface, and a strip is at least partially in the groove. A set screw passes through the sleeve to bias the strip radially away from the groove.

Embodiments of the present invention also include an alignment aid for a suppressor that includes a sleeve and an alignment slot that extends longitudinally along the sleeve. The alignment aid further includes a means for releasably engaging the sleeve to the suppressor.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
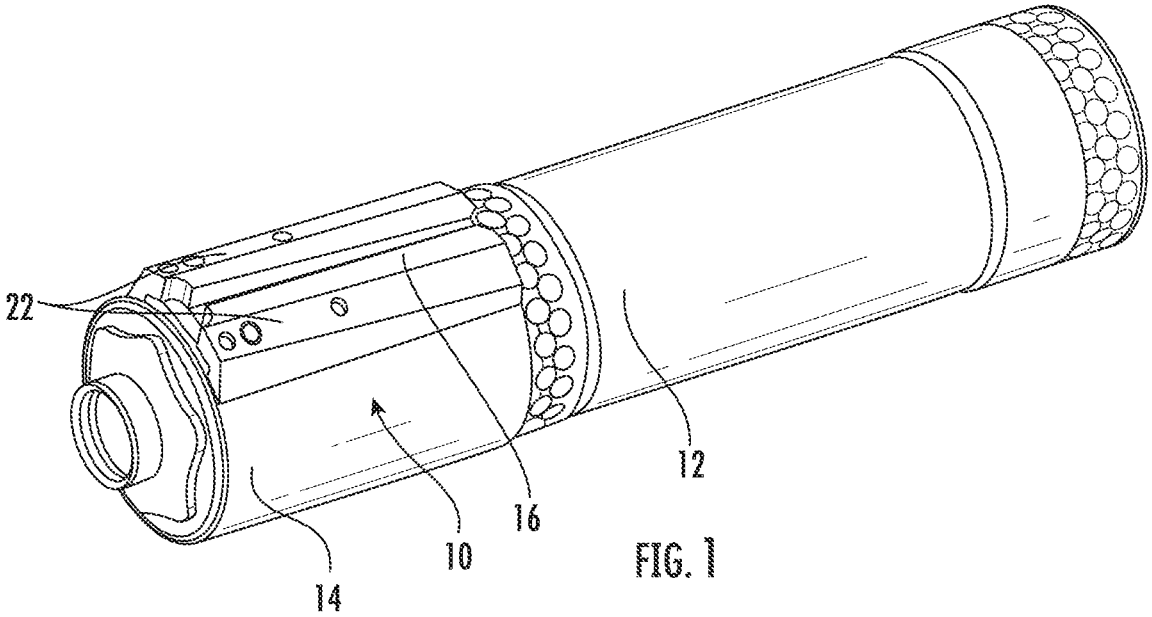
FIG. 1 is a rear perspective view of an alignment aid according to one embodiment of the present invention installed on a suppressor.

Reference will now be made in detail to example embodiments of the present disclosure, one or more examples of which are illustrated in the accompanying drawings. The detailed description uses numerical and letter designations to refer to features in the drawings. Like or similar designations in the drawings and description have been used to refer to like or similar parts of example embodiments of the present disclosure. Each example is provided by way of explanation of the present disclosure, not limitation of the present disclosure. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. As used herein, the term "longitudinal" refers to a direction along the longest dimension of an object; the term "radial" refers to a direction normal to the "longitudinal" direction, and the term "circumferential" refers to a direction extending around the circumference or perimeter of an object.

As used in the claims, the definite article "said" identifies required elements that define the scope of embodiments of the claimed invention, whereas the definite article "the" denotes environmental elements that provide context for embodiments of the claimed invention and are not intended to be a limitation of any claim.

Embodiments of the present invention provide an alignment aid for a suppressor that may supplement or replace an existing alignment feature on a firearm when the suppressor is connected to the firearm. The alignment aid includes a means for releasably connecting the alignment aid to the suppressor that facilitates installation and removal of the alignment aid from the suppressor while also protecting the suppressor from damage. In addition, the means for releasably connecting the alignment aid to the suppressor allows for precise adjustment of the orientation of the alignment aid with respect to the suppressor as the suppressor is "timed" to the firearm.

Figure 2:
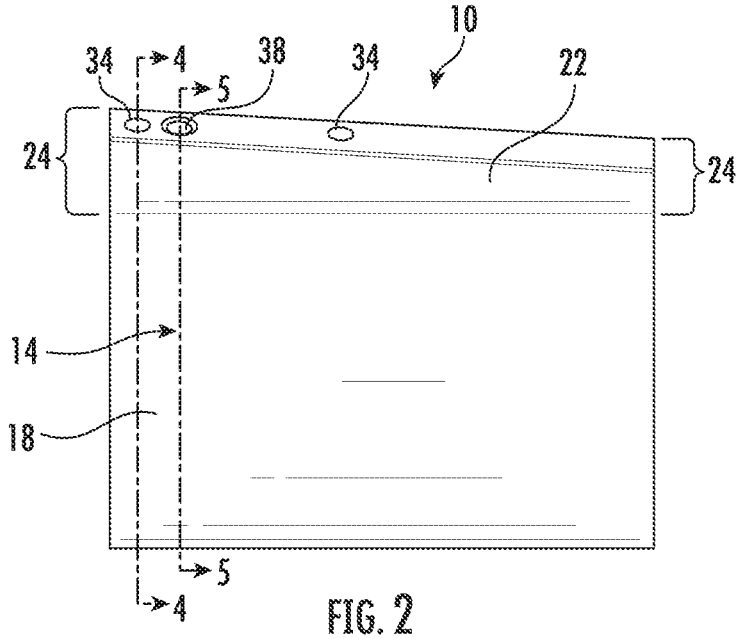
FIG. 2 is a side plan view of the alignment aid shown in FIG. 1.

FIG. 1 provides a rear perspective view of an alignment aid 10 according to one embodiment of the present invention installed on a suppressor 12, and FIG. 2 provides a side plan view of the alignment aid 10 shown in FIG. 1. The alignment aid 10 may be constructed from any material suitable for exposure to the temperatures normally associated with the discharge of the firearm. For example, in particular embodiments, the alignment aid 10 may be constructed from metal, fiberglass, carbon, polymers, or other composite materials known in the art.

As shown in FIGS. 1 and 2, the alignment aid 10 generally includes a sleeve 14 with an alignment slot 16. The sleeve 14 provides the framework for the alignment aid 10, and the size and shape of the sleeve 14 may be selected to conform to or complement the size and shape of the suppressor 12. For example, the sleeve 14 may define an external surface 18 opposed to an internal surface 20, and one or both of these surfaces 18, 20 may have a cylindrical shape to match the typically cylindrical shape of the suppressor 12. However, the particular size and shape of the sleeve 14, external surface 18, and internal surface 20 are not limitations of the present invention unless specifically recited in the claims.

The alignment slot 16 extends longitudinally along the external surface 18 of the sleeve 14. As shown in FIGS. 1 and 2, a pair of generally parallel bars 22 integrally formed by the external surface 18 of the sleeve 14 may define the alignment slot 16. Alternately, the pair of generally parallel bars 22 may be attached to the external surface 18 of the sleeve 14 using adhesive, screws, or other attachment devices to form the alignment slot 16. As shown most clearly in FIG. 2, the alignment slot 16 may have a height 24 that decreases longitudinally along the sleeve 14. Alternately or in addition, as shown more clearly in FIGS. 4 and 5, the alignment slot 16 may have a width 26 that decreases longitudinally along the sleeve 14. In this manner, the alignment slot 16 may provide a "gutter sight" for a user to align the suppressor 12, and thus the firearm, along a line of sight to the intended target.

The alignment aid 10 further includes a means for releasably engaging the sleeve 14 to the suppressor 12. The function of the means is to releasably engage the sleeve 14 to the suppressor 12. The structure for performing this function is a protective guard, such as a sheet, pad, segment, strip, or similar device, that may be selectively biased radially inward from the sleeve 14 to engage with the suppressor 12 while distributing the biasing force over a desired surface area of the suppressor 12. The protective guard may have any geometric shape with sufficient surface area to prevent the biasing force from marring or damaging the outside of the suppressor 12. For example, the protective guard may be a circular disc between the sleeve 14 and the suppressor 12 that distributes the biasing force over a greater surface area than can be provided by a conventional set screw. In other particular embodiments, the protective guard may be a rectangular segment or strip that extends longitudinally or circumferentially between the sleeve 14 and suppressor 12. A spring, set screw, or other extendable component between the sleeve 14 and the protective guard may provide the desired biasing force against the protective guard to releasably engage the sleeve 14 to the suppressor 12.

Figure 3:
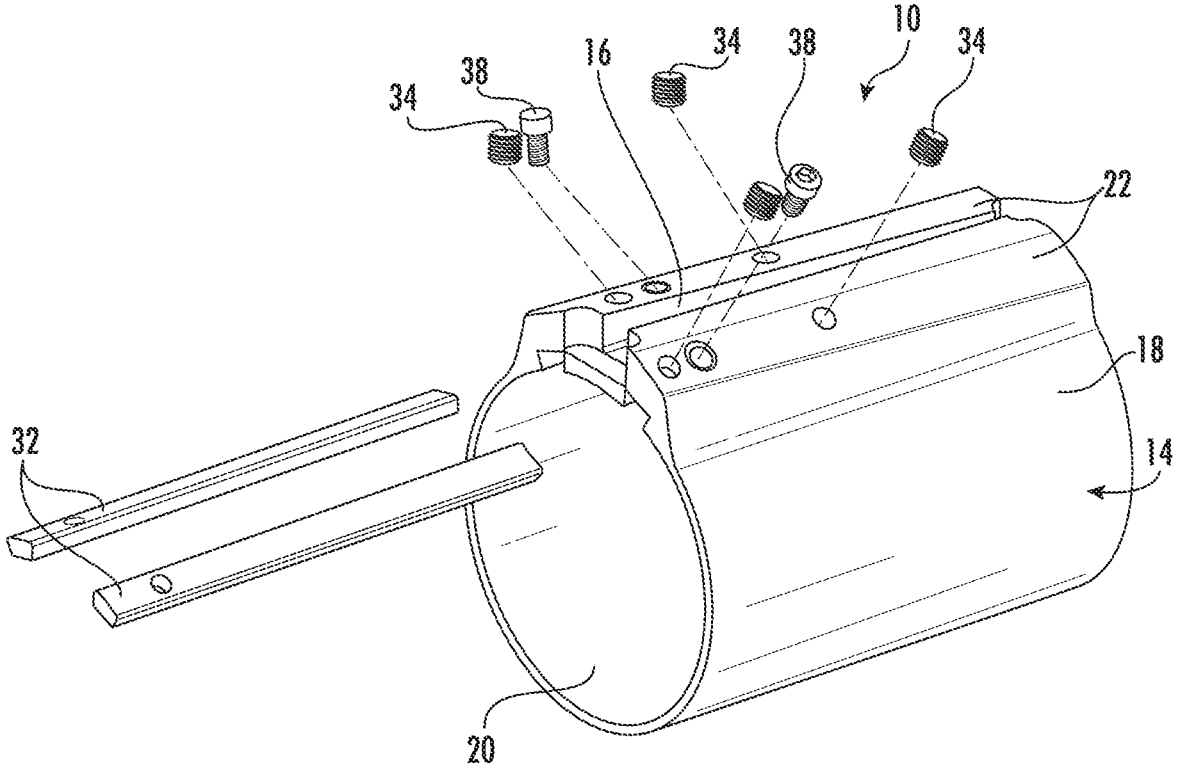
FIG. 3 is an exploded rear perspective view of the alignment aid shown in FIG. 1.
Figure 4:
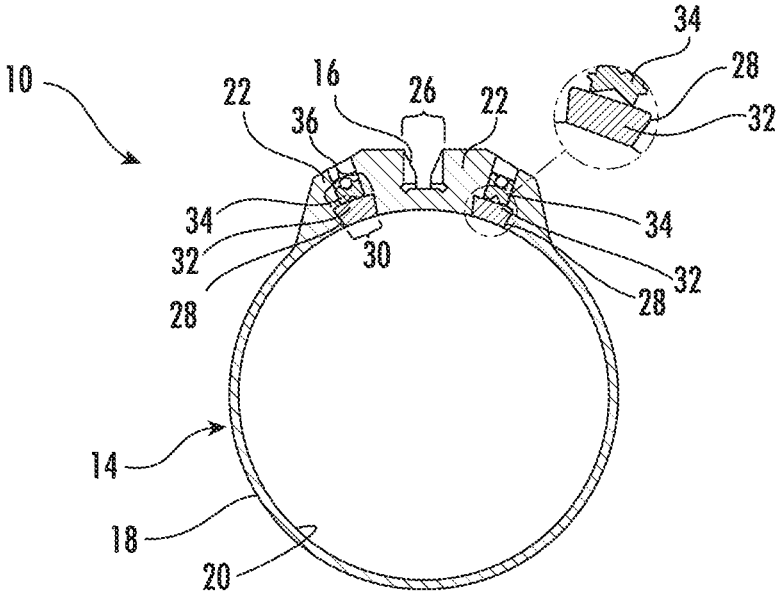
FIG. 4 is a rear cross-section view of the alignment aid shown in FIG. 2 taken along line 4-4.

FIG. 3 provides an exploded rear perspective view of the alignment aid 10 shown in FIG. 1, and FIG. 4 provides a rear cross-section view of the alignment aid 10 shown in FIG. 2 taken along line 4-4. In this particular embodiment, the internal surface 20 of the sleeve 14 defines a pair of grooves 28 that extend longitudinally along the inside of the sleeve 14. In alternate embodiments, the grooves 28 may be oriented to extend circumferentially around at least a portion of the internal surface 20 of the sleeve 14. As shown in FIG. 4, each groove 28 may optionally have a width 30 that increases radially outward in the internal surface 20.

In the particular embodiment shown in FIGS. 3 and 4, the structure for the means for releasably engaging the sleeve 14 to the suppressor 12 includes a pair of strips 32 and a pair of set screws 34 associated with each strip 32. Each strip 32 is located at least partially in the associated groove 28 and has a width 36 that increases radially outward. The clearance between the grooves 28 and the strips 32 allows the strips 32 to move radially with respect to the sleeve 14, and the tapered width of the grooves 28 and strips 32 prevents the strips 32 from falling out of the sleeve 14 when the sleeve 14 is not installed on the suppressor 12.

As shown most clearly in the enlarged portion of FIG. 4, the set screws 34 may be in threaded engagement with the sleeve 14 so that rotation of the set screws 34 alternately moves the set screws 34 radially inward or radially outward. In this manner, when the sleeve 14 is installed on the suppressor 12, the set screws 34 may be rotated to move radially inward against the strips 32 to bias the strips 32 radially inward against the suppressor 12 to engage the sleeve 14 to the suppressor 12. To remove the sleeve 14 from the suppressor 12, the set screws 34 may be rotated in the opposite direction to move radially outward to release the bias of the strips 32 against the suppressor 12.

Figure 5:
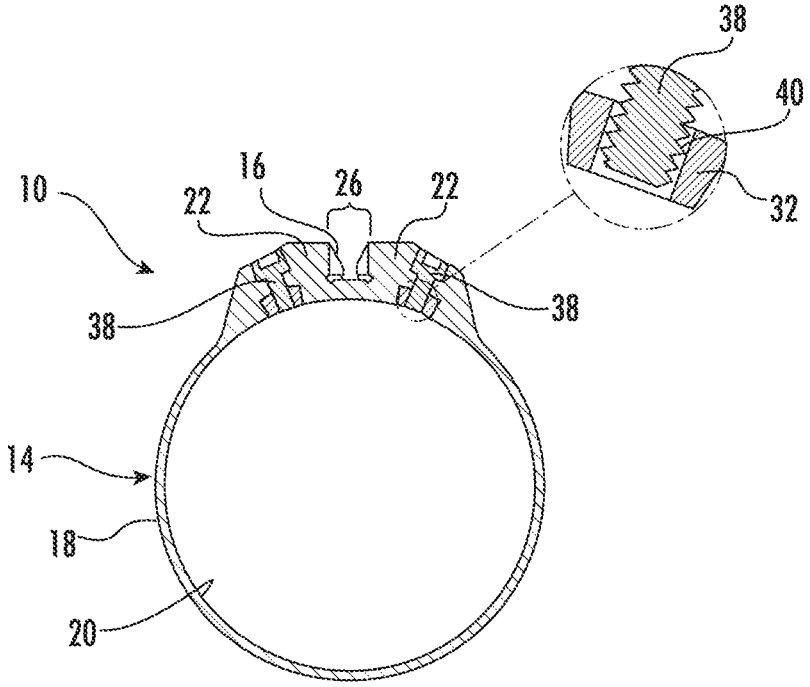
FIG. 5 is a rear cross-section view of the alignment aid shown in FIG. 2 taken along line 5-5.

FIG. 5 provides a rear cross-section view of the alignment aid 10 shown in FIG. 2 taken along line 5-5. As shown in FIGS. 3 and 5, the alignment aid 10 may further include retainer screws 38 that extend through the sleeve 14 to retain each strip 32 in place. For example, as shown most clearly in the enlarged portion of FIG. 5, each retainer screw 38 may be in threaded engagement with the sleeve 14 and extend through a collar 40 in the associated strip 32. In this manner, the retainer screws 38 limit movement of the strips 32 with respect to the sleeve 14 to prevent the strips 32 from sliding longitudinally out of the sleeve 14 when the sleeve 14 is not engaged with the suppressor 12.

The alignment aid 10 described and illustrated with respect to FIGS. 1-5 may provide several benefits over existing designs. For example, existing designs typically use set screws to releasably attach the alignment aid 10 to the suppressor 12, and the force applied by the set screws tends to damage the suppressor 12. In addition, rotation of the set screws often causes circumferential movement of the alignment aid 10 with respect to the suppressor 12, particularly when the suppressor 12 has dents or other surface damage previously caused by the set screws. In contrast, the protective guard or strip 32 included in the means for releasably engaging the sleeve 14 to the suppressor 12 distributes the bias force used to hold the alignment aid 10 in place on the suppressor 12 over a greater surface area than possible with set screws alone to prevent or minimize any marring or damage to the suppressor 12. In addition, the protective guard or strip 32 does not rotate and is not susceptible to circumferential movement with respect to the suppressor 12, so the alignment aid 10 may be precisely positioned on the suppressor 12.

The means for releasably engaging the sleeve 14 to the suppressor 12 also facilitates adjustment of the alignment aid 10 on the suppressor 12 to allow more precise placement of the alignment aid 10 during "timing" of the suppressor 12. Suppressor 12 timing refers to an iterative procedure in which the suppressor 12 is installed on a firearm, and the firearm is operated. The orientation of the suppressor 12 with respect the firearm is then changed, and the firearm is again operated to determine the orientation of the suppressor 12 that provides the greatest accuracy. The alignment aid 10 is repositioned on the suppressor 12 at each position of the suppressor 12 during the timing procedure, and the means for releasably engaging the sleeve 14 to the suppressor 12 allows the alignment aid 10 to be easily and precisely repositioned for each position of the suppressor 12 during the timing procedure.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. An alignment aid for a suppressor, comprising:
- a sleeve having an external surface and an internal surface;
- an alignment slot that extends longitudinally along said external surface of said sleeve;
- a groove in said internal surface;
- a strip at least partially in said groove; and
- a set screw engaged with said strip to bias said strip radially inward from said groove.

2. The alignment aid as in claim 1, wherein said groove extends longitudinally in said internal surface.

3. The alignment aid as in claim 1, wherein said groove has a width that increases radially outward in said internal surface.

4. The alignment aid as in claim 1, wherein said strip has a width that increases radially outward.

5. The alignment aid as in claim 1, further comprising a retainer screw engaged with said strip to limit movement of said strip with respect to said sleeve.

6. The alignment aid as in claim 1, further comprising a plurality of the grooves in said internal surface.

7. The alignment aid as in claim 1, further comprising a plurality of the set screws engaged with said strip to bias said strip radially inward from said groove.

8. An alignment aid for a suppressor, comprising:
- a sleeve;
- an alignment slot that extends longitudinally along said sleeve;
- an internal surface defined by said sleeve, wherein said internal surface is cylindrical;
- a groove in said internal surface;
- a strip at least partially in said groove; and
- a set screw that passes through said sleeve to bias said strip radially away from said groove.

9. The alignment aid as in claim 8, wherein said groove extends longitudinally in said internal surface.

10. The alignment aid as in claim 8, wherein said groove has a width that increases radially outward in said internal surface.

11. The alignment aid as in claim 8, wherein said strip has a width that increases radially outward.

12. The alignment aid as in claim 8, further comprising a retainer screw engaged with said strip to limit movement of said strip with respect to said sleeve.

13. The alignment aid as in claim 8, further comprising a plurality of the grooves in said internal surface.

14. The alignment aid as in claim 8, further comprising a plurality of the set screws engaged with said strip to bias said strip radially inward from said groove.

15. An alignment aid for a suppressor, comprising:
- a sleeve;
- an alignment slot that extends longitudinally along said sleeve; and
- a means for releasably engaging said sleeve to the suppressor.

16. The alignment aid as in claim 15, wherein said alignment slot has a width that decreases longitudinally along said sleeve.

17. The alignment aid as in claim 15, further comprising a retainer screw engaged with said means for releasably engaging said sleeve to the suppressor.

18. The alignment aid as in claim 15, wherein said means for releasably engaging said sleeve to the suppressor comprises a strip inside said sleeve that moves radially with respect to said sleeve to releasably engage with the suppressor.

19. The alignment aid as in claim 15, wherein said means for releasably engaging said sleeve to the suppressor comprises a set screw in threaded engagement with said sleeve.

20. The alignment aid as in claim 15, further comprising a groove in said sleeve, and said means for releasably engaging said sleeve to the suppressor extends radially inward from said groove.

* * * * *